United States Patent [19]

Tolliver

[11] 4,280,310

[45] Jul. 28, 1981

[54] HINGED REINFORCEMENT ASSEMBLY AND METHOD

[76] Inventor: Wilbur E. Tolliver, 364 Hamilton Dr., Holland, Mich. 49423

[21] Appl. No.: 41,935

[22] Filed: May 23, 1979

[51] Int. Cl.[3] ..... E04H 12/18

[52] U.S. Cl. ..... 52/646; 52/650; 52/745

[58] Field of Search ..... 52/722, 723, 646, 650, 52/664, 600, 745; 220/19; 249/11, 48; 16/192

[56] References Cited

U.S. PATENT DOCUMENTS

| | | | |
|---|---|---|---|
| 1,115,491 | 11/1914 | Bindley et al. | 52/646 |
| 1,141,385 | 6/1915 | Ellinger | 52/646 |
| 1,708,352 | 4/1929 | Barton | 52/646 X |
| 3,344,571 | 10/1967 | Day, Jr. | 52/646 X |
| 3,367,084 | 2/1968 | Reiland | 52/722 X |
| 3,863,416 | 2/1975 | Oroschakoff | 52/646 |
| 4,050,606 | 9/1977 | Jurasek | 220/19 X |

*Primary Examiner*—Carl D. Friedman

*Attorney, Agent, or Firm*—Price, Heneveld, Huizenga & Cooper

[57] ABSTRACT

The specification discloses a welded wire reinforcement for box culverts which four welded wire panels are hingedly joined by helical hinges so that the assembly can be shipped flat, erected on the job and held in erected position by crimping the helical hinges at various points.

7 Claims, 5 Drawing Figures

HINGED REINFORCEMENT ASSEMBLY AND METHOD

BACKGROUND OF THE INVENTION

The present invention relates to reinforcing concrete products, particularly box culverts or similar objects of a generally rectangular cross section. Typically, such objects are reinforced with some sort of welded wire assembly wherein different lengths of wire rod are welded to other lengths of wire rod in a criss cross pattern and wherein the entire assembly is shaped to a generally rectangular configuration. Examples of such rectangular reinforcements are disclosed in the United States patent to Congy U.S. Pat. No. 3,375,632, issued Apr. 2, 1968 and entitled REINFORCEMENT ELEMENT FOR BEAMS AND POLES MADE FROM REINFORCED CONCRETE, and to McFarland U.S. Pat. No. 2,225,226 which issued Dec. 17, 1940 and is entitled REINFORCEMENT STIRRUP ASSEMBLY.

Such rectangular shaped reinforcements are cumbersome to ship, store and handle. Some prior artisans reinforced box culverts with four flat sheets of welded wire fabric of proper dimensions. The culvert producer wires or welds the four separate sheets together in a rectangular configuration on the job. Unfortunately, the manual labor involved in this process is costly.

SUMMARY OF THE INVENTION

The present invention obviates prior art difficulties by providing four, generally flat sheets of welded wire wherein a plurality of generally longitudinal wires are joined to a plurality of transverse wires, and wherein all four sheets are hingedly joined at their edges. In this way, the assembly can be shipped flat and stored flat and can later be erected at the producer's plant into a generally rectangular shape and placed in a box culvert form.

These and other objects, advantages and features of the invention will be more fully understood and appreciated by reference to the written specification and appended drawings.

DESCRIPTION OF THE PREFERRED EMBODIMENT

Figure 1:
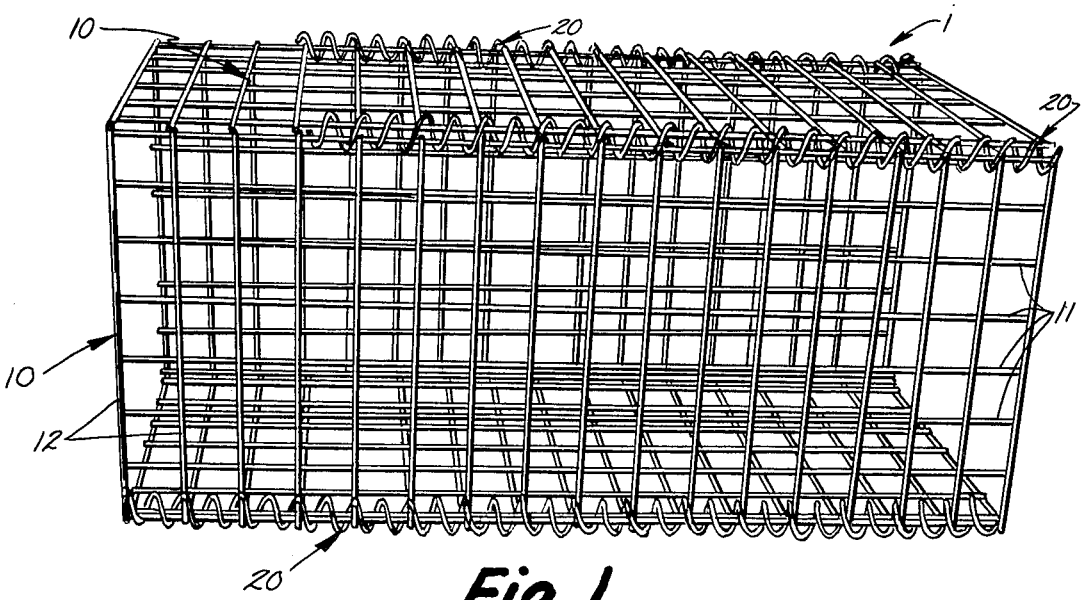
FIG. 1 is a perspective view of the reinforcement assembly of the present invention.
Figure 2:
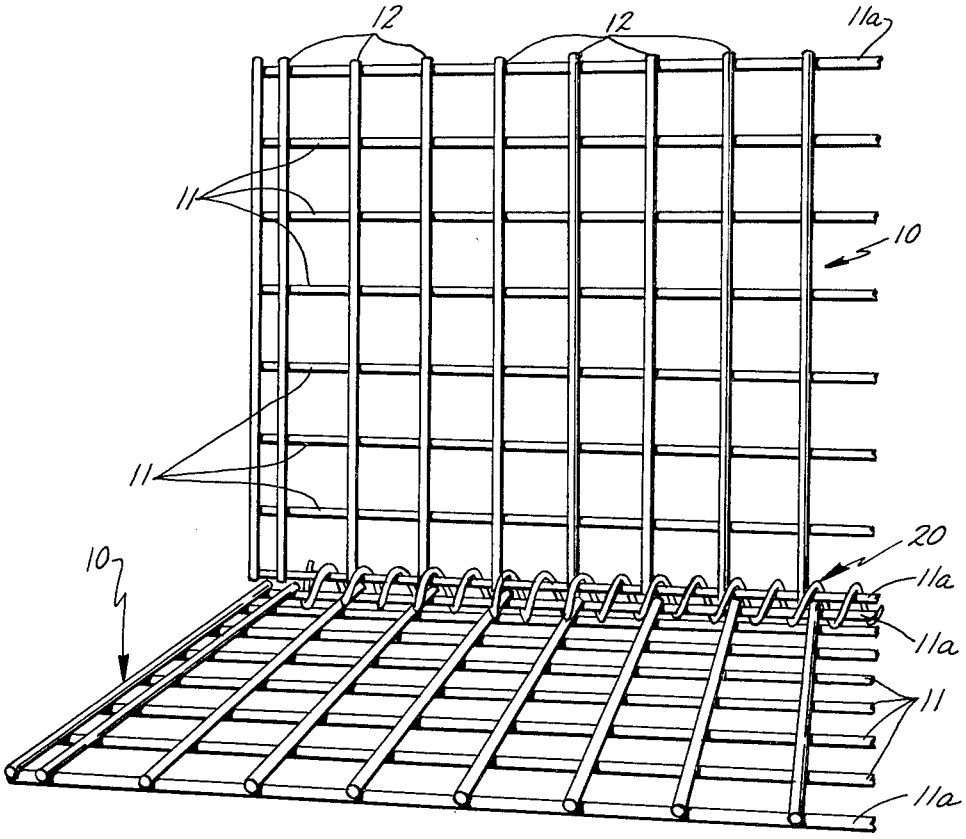
FIG. 2 is an enlarged view showing two sections of welded wire fabric hinged together in accordance with the present invention.

The reinforcement assembly 1 of the present invention comprises four generally flat sheets 10 hingedly joined to one another by four helical hinges 20 (FIGS. 1 through 4). Each of the fabric sheets 10 is conventional in construction, comprising a plurality of longitudinal strands 11 joined to a plurality of generally parallel transverse strands 12. Each helical hinge 20 is coiled over the adjacent edge longitudinal wires 11*a* of adjacent sheets 10.

In order to assemble the four welded wire sheets 10 together, one simply twists the end of helical hinge 20 over the end of adjacent edge longitudinals 11*a* and continues twisting until hinge 20 has progressed down the length of strands 11*a* to the point where it no longer protrudes from the end of the assembly 1. Helical hinge 20 will readily snake around the intervening transverse strands 12 as it progresses down the length of the adjacent edge longitudinals 11*a*. It is not even essential that helical hinge 20 extend down the full length of adjacent sheets 10. Thus FIG. 1 illustrates both a full length hinge 20 and a hinge 20 which goes only about ¾ of the way down the length of adjacent sheets 10.

Helical hinge 20 should be made of a material which is sufficiently stiff and rigid that it can be twisted into position on edge longitudinals 11*a* without uncoiling. If the helical hinge 20 were to uncoil, manufacturing the reinforcement assembly 1 of the present invention could become a very difficult and costly operation.

Figure 3:
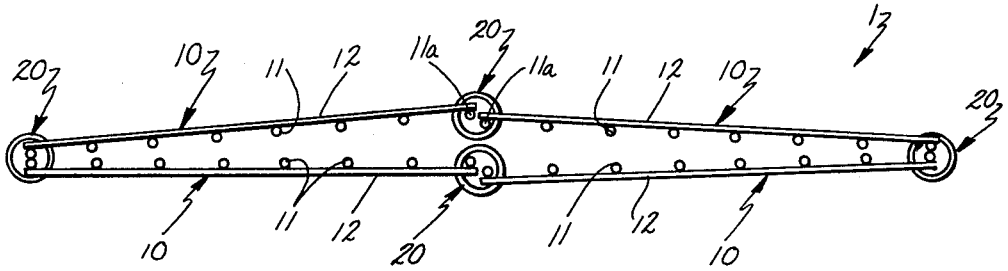
FIG. 3 is an end elevational view of the reinforcement assembly of the present invention layed in its generally flat condition.
Figure 4:
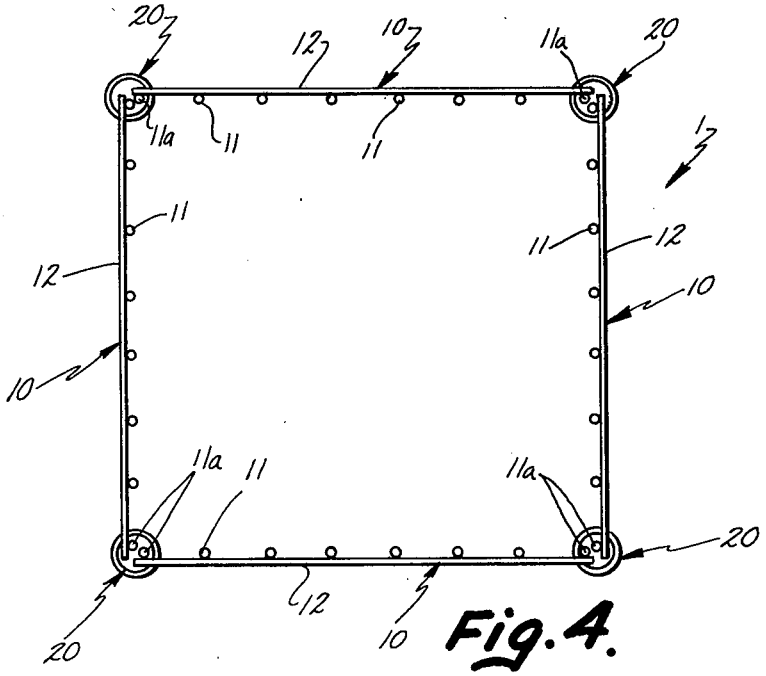
FIG. 4 is an end elevational view of the assembly of the present invention when it is in its erected condition.
Figure 5:
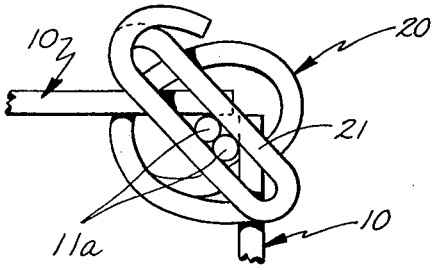
FIG. 5 is an enlarged, fragmentary view showing the manner in which the helical hinge employed in the present invention can be crimped to lock the reinforcement assembly into its erected condition.

On the other hand, the wire material of helical hinge 20 should be sufficiently bendable that it can be readily crimped with a pair of pliers or the like. That is because in operation, when one erects the reinforcement assembly 1 from its slack position as shown in FIG. 3 to its erected position as shown in FIG. 4, one wants to be able to secure the assembly in a erected position. This can be accomplished by taking a pair of pliers or the like and crimping helical hinge 20 at two or three points along its length. A crimp 21 can be seen by reference to FIG. 5.

Even crimping one helical one helical hinge 20 at several points along its length theoretically assures the culvert assembly 1 will stay in its erected position to a sufficient degree to allow one to cast concrete about it in a box culvert form or the like. However, by crimping two, three or all four of the helical hinges 20 in assembly 1, one further rigidifies the assembly and thereby helps to insure that it will hold its generally rectangular configuration during the culvert casting operation.

I have found that 4 to 12 gauge bright basic wire works very well as helical hinge 20. As for the various longitudinal wires 11, 11*a* and transverse wires 12 of fabric sheets 10, these can be made of any conventional concrete reinforcement wire material. Various alternatives are available to engineers who are designing the box culverts or the like.

The helical hinge concept of the present invention has applicability not only in the four sheet assembly of the present invention, but also in any situation where one is hinging one reinforcing member to another where both have parallel longitudinal wires with a plurality of transverse wires projecting from those parallel longitudinal wires. For example, one might hinge a stirrup element, which has one longitudinal tie wire from which a plurality of stirrup members project laterally, to a welded wire reinforcing cylindrical cage. Such a cage comprises a plurality of longitudinal wires joined to a plurality of circumferential wires. Such an assembly of stirrup members to cage would be useful in making reinforced concrete pipe. As with the preferred embodiment assembly 1, one merely crimps the helical hinge 20 at various points along the length to hold the stirrup member in its erected condition.

Comparably, it is contemplated that the reinforcement assembly of the present invention will be assembled by the manufacturer and shipped to the producer in collapsed, flattened form. The producer will then simply erect the assembly, crimp the helical hinges with the assembly in its erected position and place the assembly in a concrete form. However more broadly, the pipe producer himself could assemble the helical hinges to the four flat sheets and then proceed as outlined above. Alternatively, the unit might be shipped with only three of the helical hinges in place leaving two sides not joined to one another. The advantage to this approach is that one can fold the unit in accordian fashion so that it is only one panel wide instead of two panels wide as would have to be the case where all four sides are helically hinged. If such a unit were shipped to the producer, he would then erect it and would only have to join two sides with one helical hinge. Then, he would proceed with the erecting, crimping and locating steps described above.

Of course, it is understood that above are merely preferred embodiments of the invention and that various changes and alterations can be made without departing from the spirit and broader aspects of the invention as set forth in the appended claims, interpreted in accordance with the prior art and in accordance with the doctorine of equivalents.

The embodiments of the invention in which an exclusive property or privilege is claimed are defined as follows:

1. A welded wire concrete reinforcement assembly comprising: four generally flat sheets of wire reinforcement, each comprising a plurality of generally parallel longitudinal wire strands joined to a plurality of generally parallel transverse strands oriented transversely with respect to said longitudinal strands; hinge means joining said generally flat sheets at their edges; said assembly having a flat, folded configuration for shipping and storage, and an erected configuration wherein said sheets are disposed in a generally rectangular relationship; said hinge means comprising a helical wire coiled about the adjacent edge longitudinal wires in said adjacent sheets of welded wire fabric, and wherein said helical wire is constructed of a material which is sufficiently stiff that it is twisted onto said adjacent longitudinal wires during assembly of said sheets without uncoiling, and is sufficiently bendable that in said erected configuration it is in a crimped condition at various points along its length to hold said reinforcement assembly in its erected condition.

2. In a welded wire concrete reinforcement assembly, the improvement comprising: a first reinforcement member having a plurality of generally parallel longitudinal wire strands joined by a plurality of generally parallel transverse strands oriented transversely with respect to said longitudinal strands; and a second reinforcement member comprising at least one longitudinal strand with a plurality of wires projecting transversely therefrom; said longitudinal strand of said second member being positioned adjacent one of said longitudinal strands of said first member; a helical wire coiled over said adjacent longitudinal strands to hingedly join said first and second members together; said first and second reinforcement members having a generally flat, folded configuration for shipping and storage, and an erected, unfolded configuration for casting concrete thereabout; said helical wire being sufficiently stiff so that it is twisted over said adjacent longitudinal wires without uncoiling, but being sufficiently bendable that in said erected configuration said helical wire is in a crimped condition at various points along its length to thereby hold said first and second reinforcing members in said erected configuration, in a fixed orientation with respect to one another.

3. A welded wire concrete reinforcement assembly comprising:

four generally flat sheets of wire reinforcement, each comprising a plurality of generally parallel longitudinal wire strands joined to a plurality of generally parallel transfer strands oriented transversely with respect to said longitudinal strands;

hinge means joining said generally flat sheets along three edges; said assembly having a flat, folded configuration for shipping and storage and an erected configuration wherein said sheets are disposed in a generally rectangular relationship and the two non-joined sheets are joined together just prior to being placed into a form for casting concrete around said assembly; wherein said hinge means comprises a helical wire coiled about the adjacent edge longitudinal wires in said adjacent sheets of welded wire fabric; and said helical wires being constructed of a material which is sufficiently stiff that just prior to erection of the assembly the wires are twisted onto said adjacent longitudinal wires without uncoiling, and is sufficiently bendable that in said erected configuration it is in a crimped condition at various points along its length to hold said reinforcement assembly in its erected condition.

4. A method for reinforcing concrete box culverts or like concrete products comprising:

providing four generally flat sheets of wire reinforcement, each comprising a plurality of generally parallel longitudinal wire strands joined to a plurality of generally parallel transverse strands oriented transversely with respect to said longitudinal strands;

hingedly joining said generally flat sheets at their edges by hinge means by coiling a helical wire about the adjacent edge longitudinal wires in said adjacent sheets of welded wire fabric; said helical wire being of a material which is sufficiently stiff that it can be twisted onto said adjacent longitudinal wires without uncoiling, but is sufficiently bendable that it can be crimped at various points along its length to hold said reinforcement assembly in its erected condition;

erecting said resulting assembly into a generally rectangular configuration, including crimping said helical at various points along its length to hold said reinforcement assembly in its erected condition, and placing the erected rectangular configuration into a form;

casting concrete around said erected assembly.

5. A method for reinforcing concrete box culverts or like products comprising:

providing four generally flat sheets of wire reinforcement, each comprising a plurality of generally parallel longitudinal wire strands joined to a plurality of generally parallel transverse strands oriented transversely with respect to said longitudinal strands;

hingedly joining said generally flat sheets with three hinge means along their adjacent edges whereby all four sheets are joined together but two of the four sheets are not joined directly to each other;

erecting said resulting assembly into a generally rectangular configuration, joining said two non-joined sheets along adjacent edges and placing the erected rectangular configuration into a form; casting concrete around said erected assembly.

6. The method of claim 5 wherein said step of hingedly joining said flat sheets at their edges comprises coiling a helical wire about the adjacent edge longitudinal wires in said adjacent sheets of welded wire fabric.

7. The method of claim 6 wherein said step of coiling said helical wire includes providing wire of a material which is sufficiently stiff that it can be twisted onto said adjacent longitudinal wires without uncoiling, but is sufficiently bendable that it can be crimped at various points along its length to hold said reinforcement assembly in its erected condition; and said step of erecting said assembly into a generally rectangular configuration including crimping said helical wire at various points along its length to hold said reinforcement assembly in its erected condition.

* * * * *